US007837750B2

(12) United States Patent
Katinas et al.

(10) Patent No.: US 7,837,750 B2
(45) Date of Patent: Nov. 23, 2010

(54) SYSTEM AND METHOD FOR CLEANING A DIESEL PARTICULATE FILTER USING ACOUSTIC WAVES

(75) Inventors: Jade Katinas, Chillicothe, IL (US); Dong Fei, Peoria, IL (US); Jamie Frisch, Peoria, IL (US); Jeremy Trethewey, Elkton, MD (US); Douglas Rebinsky, Peoria, IL (US); Nan Yang, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 359 days.

(21) Appl. No.: 11/879,472

(22) Filed: Jul. 17, 2007

(65) Prior Publication Data

US 2009/0020136 A1 Jan. 22, 2009

(51) Int. Cl.

| | |
|---|---|
| ***B08B 7/02*** | (2006.01) |
| ***B08B 9/027*** | (2006.01) |
| ***B08B 11/02*** | (2006.01) |

(52) U.S. Cl. ..... 55/292; 55/300; 55/523; 55/DIG. 30; 134/1; 134/184

(58) Field of Classification Search ..... 134/1, 134/184; 55/292, 300
See application file for complete search history.

(56) References Cited

U.S. PATENT DOCUMENTS

| | | | | |
|---|---|---|---|---|
| 5,062,965 | A * | 11/1991 | Bernou et al. | 210/785 |
| 5,900,043 | A * | 5/1999 | Grandjean et al. | 95/29 |
| 6,290,778 | B1 * | 9/2001 | Zugibe | 134/1 |
| 6,964,694 | B2 | 11/2005 | Rauchfuss et al. | |
| 2005/0011357 | A1 | 1/2005 | Crawley | |
| 2007/0137150 | A1 * | 6/2007 | Goddard | 55/282 |
| 2008/0155969 | A1 * | 7/2008 | DaCosta et al. | 60/295 |

OTHER PUBLICATIONS

Pending publication of U.S. Appl. No. 11/319,025; filed Dec. 27, 2005; Sellers et al.; System And Method For Cleaning A Diesel Particulate Filter Using Acoustic Waves.

* cited by examiner

*Primary Examiner*—Michael Kornakov
*Assistant Examiner*—Natasha Campbell
(74) *Attorney, Agent, or Firm*—Liell & McNeil

(57) ABSTRACT

A method for cleaning a diesel particulate filter includes a step of coupling an acoustic generator directly to the diesel particulate filter via a support fixture. Ash deposited within the diesel particulate filter is dislodged with acoustic energy deposited by the acoustic generator. The ash may fall clear of the diesel particulate filter under the action of gravity and/or via pressurized air flow.

6 Claims, 3 Drawing Sheets

SYSTEM AND METHOD FOR CLEANING A DIESEL PARTICULATE FILTER USING ACOUSTIC WAVES

TECHNICAL FIELD

The present disclosure relates generally to cleaning a diesel particulate filter, and more particularly to dislodging ash deposited within the diesel particulate filter using acoustic energy generated from an acoustic generator.

BACKGROUND

Diesel particulate filter assemblies are one of many types of emission control technologies that lower particulate matter emissions. Typically, a diesel particulate filter assembly includes a housing containing a catalyst substrate consisting of a plurality of longitudinal passages. At each end of the substrate, alternate openings are closed, so that each passage is closed at one end and open at the other. Exhaust gases that enter the filter assembly through an unblocked opening must pass through the thin walls in order to exit the filter assembly. Particulate matter that is unable to pass through the walls is thereby filtered and prevented from exiting the filter assembly.

By trapping particulate matter as exhaust gases pass through the filter, diesel particulate filter assemblies are able to greatly reduce particulate matter emissions and assist in the compliance with increasingly stringent emissions standards. While filter assemblies are generally effective and easy to maintain, they require periodic cleaning to prevent blockage. If a filter assembly becomes blocked, the filter assembly, and even the engine, can become damaged through excessive back pressure.

Most trapped particulate matter can be removed from the filter assembly through regeneration. This involves heating the particulate matter to combustion or oxidation levels. Regeneration, however, does not remove all particulate matter. Remaining particulate matter, or ash, may become trapped in the filter assembly and may gradually build up and plug the passages of the substrate. This ash must be periodically removed to prevent decreased efficiency of the filter assembly.

One such method for flushing ash from a diesel particulate filter is disclosed in U.S. Published Application No. 2005/0011357. Specifically, a liquid is pumped through a filter from the outlet to the inlet. Ultrasonic waves, generated by an acoustic generator, are imparted in the fluid and assist in dislodging ash from the filter. This method, however, does not provide for direct coupling of the acoustic generator to the filter in order to increase the amount of ultrasonic energy propagated throughout the filter, and to avoid inconveniences presented by fluids.

The present disclosure is directed to one or more of the problems set forth above.

SUMMARY OF THE DISCLOSURE

In one aspect, a method for cleaning a diesel particulate filter includes a step of coupling an acoustic generator directly to the diesel particulate filter. The method also includes a step of generating acoustic energy from the acoustic generator. The method also includes a step of dislodging ash deposited within the diesel particulate filter using the acoustic energy.

In another aspect, a system for cleaning a diesel particulate filter includes a support fixture for supporting a diesel particulate filter and an acoustic generator for generating acoustic energy. One of the support fixture and the acoustic generator is movable with respect to the other. A coupling pad transfers the acoustic energy from the acoustic generator through the diesel particulate filter to remove ash deposited within the diesel particulate filter.

In yet another aspect, a method for servicing a machine having an exhaust aftertreatment system includes a step of removing a diesel particulate filter from the exhaust aftertreatment system. The method also includes a step of dislodging ash deposited within the diesel particulate filter using acoustic energy generated from an acoustic generator. Attenuation of the acoustic energy is reduced via a solid connection.

DETAILED DESCRIPTION

Figure 1:
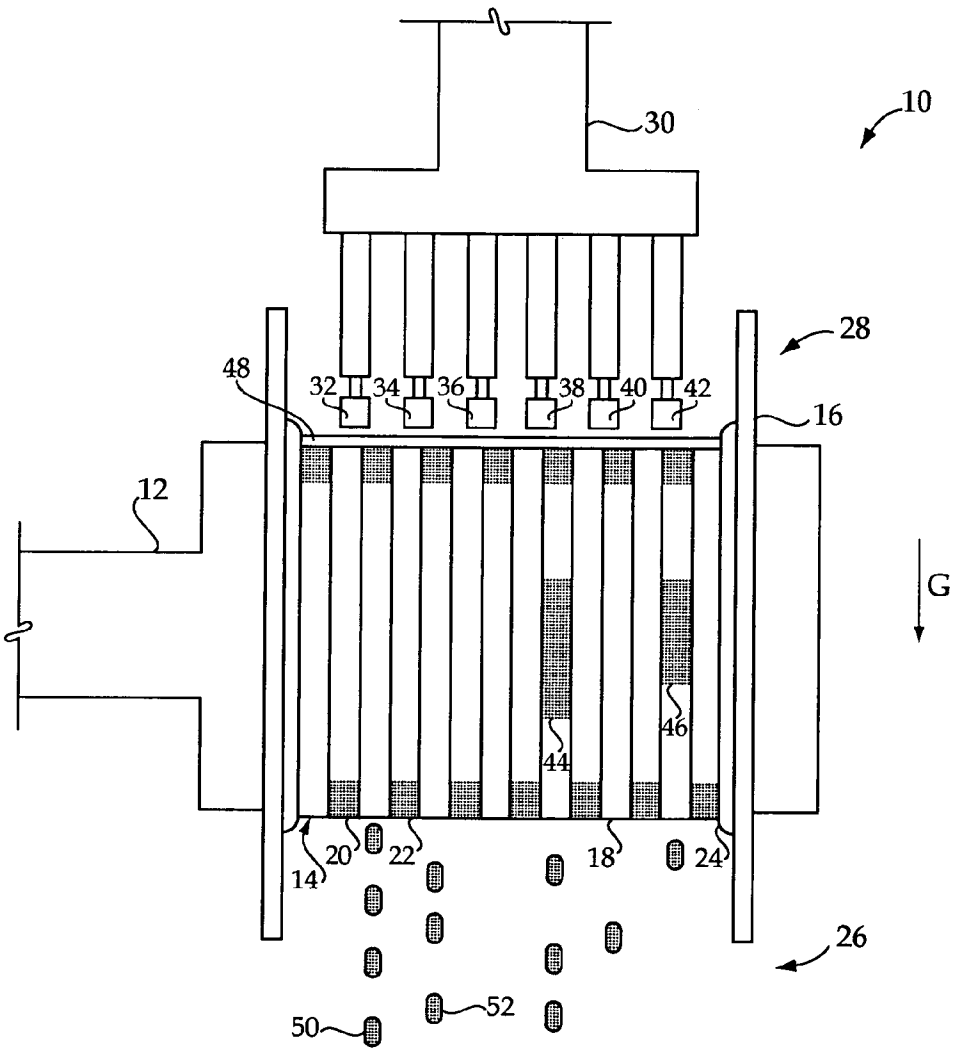
FIG. 1 is a side diagrammatic view of a system for cleaning a diesel particulate filter according to the present disclosure.

An exemplary embodiment of a system 10 for cleaning a diesel particulate filter assembly is shown generally in FIG. 1. The system 10 includes a support fixture 12 for supporting a diesel particulate filter assembly 14. The diesel particulate filter assembly 14 is shown in cross section and typically includes a cylindrical housing 16 supporting a catalyst substrate or filter 18. The filter 18 includes thin walls defining longitudinal passages that extend from a gas inlet to a gas outlet of the filter 18. Although only a limited number of passages are shown, it should be appreciated that a typical filter 18 comprises numerous passages. The passages are blocked at one end and open at the other to force exhaust gases entering the filter 18 through an open passage to pass through the thin walls and exit the filter 18 through a different open passage. Passages may be blocked by plugs, such as, for example, plugs 20 and 22. Particulate matter within the exhaust gases is then trapped within the passage walls. In order to avoid damage to the delicate thin walls of the filter 18 from vibration and shock during use and to prevent exhaust gases from passing between the filter 18 and housing 16, a mat 24, or other shock absorbing layer, is typically disposed between the filter 18 and the housing 16.

Diesel particulate filters, such as diesel particulate filter assembly 14, are well known to those skilled in the art and may be provided as part of an exhaust aftertreatment system for use with an engine. Although a particular embodiment is shown at 14, it should be appreciated that any device that filters particulate matter from exhaust gases and is subject to residual ash buildup in the passages thereof is contemplated for use with the system 10 of FIG. 1. The diesel particulate filter assembly 14, as shown, has already been removed from an exhaust aftertreatment system and may have been removed as part of routine maintenance on the exhaust aftertreatment system. End caps, not shown, for connecting the diesel particulate filter assembly 14 to exhaust conduits may have also been removed to facilitate cleaning of the filter 18.

The support fixture 12 may include any device or structure for supporting the diesel particulate filter assembly 14. The support fixture 12 may include an arm extending from a base that has an annular ring or other structure on the end thereof for frictionally engaging the diesel particulate filter assembly 14. Alternatively, the support fixture 12 may include a surface for supporting the diesel particulate filter assembly 14 on a top portion thereof. Any alternative structure for facilitating a relatively fixed position of the diesel particulate filter assembly 14 is also contemplated.

It may be desirable to position the diesel particulate filter assembly 14 vertically, with a gas inlet 26 facing downward and a gas outlet 28 facing upward, as shown. Alternatively, however, it may be desirable to position the diesel particulate filter assembly 14 with the gas inlet 26 facing upward and the gas outlet 28 facing downward. Further, it may be desirable to position the diesel particulate filter assembly 14 horizontally or at any other desired orientation.

Figure 2:
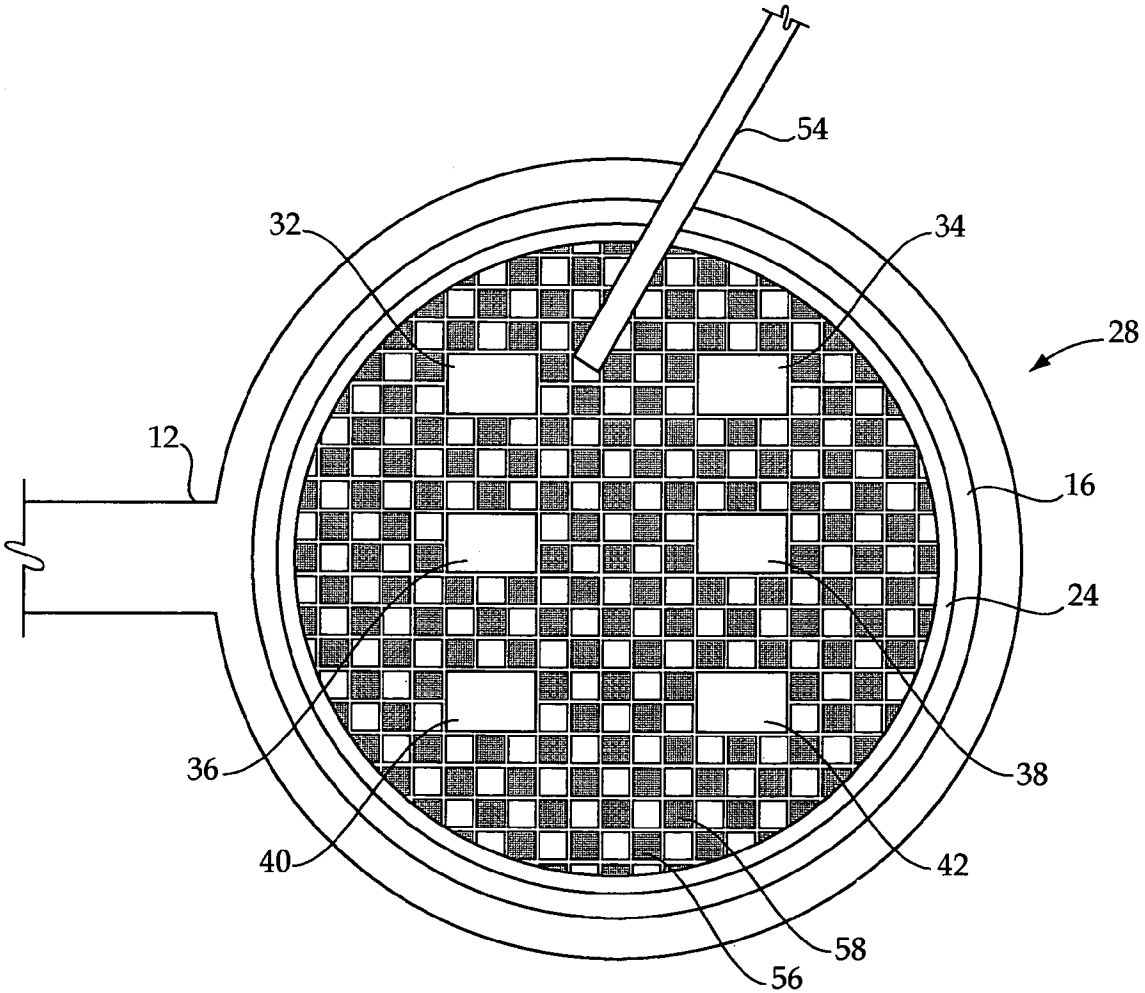
FIG. 2 is a top diagrammatic view of one embodiment of the diesel particulate filter of FIG. 1 according to the present disclosure.

The system 10 also includes an acoustic generator 30. Acoustic generators are well known and may include any device for producing sound and/or ultrasound. The acoustic generator 30 may, for example, include a single transducer, a transducer array (as shown), or a phased array transducer. The acoustic generator 30 is shown having an array of transducers, such as transducers 32, 34, 36, 38, 40, and 42, such as, for example, sonic transducers or ultrasonic transducers. It should be appreciated that the acoustic generator 30 may include a one-dimensional or a two-dimensional array of transducers and/or elements extending across a face of the gas outlet 28 or any other alternative arrangement of transducers or elements. As shown in FIG. 2, transducers 32, 34, 36, 38, 40, and 42 may be positioned in any arrangement across the surface of gas outlet 28. It should be noted that the gas outlet 28 is shown having passages that are blocked at one end and open at the other. Passages are typically blocked by plugs, such as, for example, plugs 56 and 58. Although the passages are shown having a square shape, it should be appreciated that the passages may comprise any other geometric shape.

A phased-array transducer is also contemplated for the acoustic generator 30 of system 10. A phased-array transducer is also well known and includes a plurality of elements, such as piezoelectric elements, for producing sound and/or ultrasound in response to an applied voltage. For a transducer array or phased-array transducer implementation, it may be desirable to manipulate the amplitude and phase of the driving voltages applied to each transducer or element to direct the sound or ultrasound to targeted areas of the filter 18 and reach all ash, such as, for example, ash 44 and 46 of FIG. 1, deposited within the filter 18. It may also be desirable to produce sonic or ultrasonic energy having a modulated or, alternatively, an unmodulated frequency, in a continuous or periodic burst mode.

The acoustic generator 30 is ultimately placed in contact with the filter 18 of the diesel particulate filter assembly 14. In order to facilitate coupling, it may be desirable for one of the support fixture 12 and the acoustic generator 30 to be movable with respect to the other. For example, the diesel particulate filter assembly 14 may first be supported by support fixture 12 and, thereafter, moved into contact with the acoustic generator 30. Alternatively, however, the acoustic generator 30 may be moved into contact with at least the filter 18 of the diesel particulate filter assembly 14. Regardless of the coupling process, the acoustic generator 30 is ultimately in direct contact with the filter 18 in order to maximize the use of the acoustic energy and prevent significant attenuation, such as can occur with imparting the acoustic energy through liquid or air.

A coupling pad 48 may also be provided for transferring the acoustic energy from the acoustic generator 30 through the diesel particulate filter assembly 14. A dry coupling pad, such as coupling pad 48, is desirable where a liquid is not practical or desirable and because air causes such a high attenuation to sound and ultrasound. Any gaps existing between the acoustic generator 30 and the surface of the filter 18 may cause a large portion of the acoustic energy to be reflected back to the acoustic generator 30 rather than into the filter 18. The coupling pad 48, therefore, serves to prevent this attenuation and protect the delicate structure of the filter 18 from damage due to the high-energy vibrations produced by the acoustic generator 30. The coupling pad 48 may be integral with the acoustic generator 30 or, alternatively, may be a separate entity. In addition, the coupling pad 48 may cover all or a portion of a surface area of gas outlet 28 or may only cover areas of the gas outlet 28 directly contacted by transducers 32, 34, 36, 38, 40, and 42. While any number of materials is contemplated for the coupling pad 48, it may be desirable to use something deformable and durable, such as, for example, a high-strength rubber, paper, or soft metal.

INDUSTRIAL APPLICABILITY

Referring to FIGS. 1 and 2, a system 10 for cleaning a diesel particulate filter assembly 14 generally includes a support fixture 12 for supporting the diesel particulate filter assembly 14 and an acoustic generator 30 for producing sound and/or ultrasound. Diesel particulate filter assemblies, such as assembly 14, are well known and typically consist of a cylindrical housing 16 that supports a catalyst substrate or filter 18. The filter 18 includes thin walls defining longitudinal passages that extend from a gas inlet 26 to a gas outlet 28 of the filter 18. The passages are blocked at one end and open at the other, such as, for example, by plugs 20 and 22, to force exhaust gases entering the filter 18 through an open passage to pass through the thin walls and exit the filter 18 through a different open passage. Particulate matter within the exhaust gases is then trapped within the passage walls.

By trapping particulate matter as exhaust gases pass through the filter 18, diesel particulate filter assemblies, such as assembly 14, are able to greatly reduce particulate matter emissions and assist in the compliance with increasingly stringent emissions standards. While diesel particulate filter assemblies, such as assembly 14, are generally effective and easy to maintain, they require periodic cleaning to prevent blockage. If the diesel particulate filter assembly 14 becomes blocked, the assembly 14, and even the engine, can become damaged through excessive back pressure.

Most trapped particulate matter can be removed from the diesel particulate filter assembly 14 through regeneration. This involves heating the particulate matter to combustion or oxidation levels. Regeneration, however, does not remove all particulate matter. Remaining particulate matter, or ash, may become sintered and, thereafter, trapped in the diesel particulate filter assembly 14 and may gradually plug the passages of the filter 18. The ash, such as, for example, ash 44 and 46, must be periodically removed to prevent decreased efficiency of the diesel particulate filter assembly 14.

Figure 3:
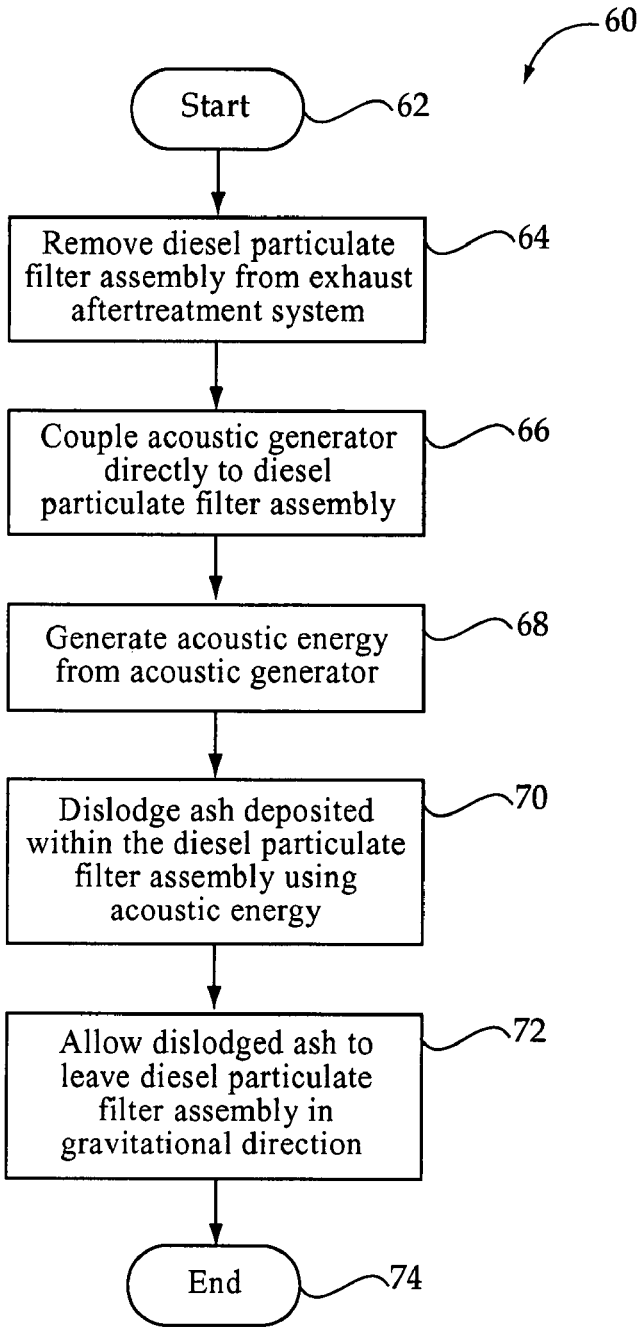
FIG. 3 is a flow chart of one embodiment of a method for cleaning a diesel particulate filter according to the present disclosure.

Utilizing the system and method for cleaning a diesel particulate filter assembly, such as assembly 14, according to the present disclosure may help to improve performance and extend the life of the diesel particulate filter assembly 14 by removing the sintered particulate matter, or ash 44 and 46. Turning to FIG. 3, there is shown a flow chart 60 representing an exemplary method of cleaning diesel particulate filter assembly 14 utilizing the system 10 of FIG. 1. The method begins at a START, Box 62. From Box 62, the method proceeds to Box 64, which includes the step of removing the diesel particulate filter assembly 14 from an exhaust aftertreatment system. The diesel particulate filter assembly 14 may be removed periodically as part of routine maintenance of the exhaust aftertreatment system or the diesel particulate filter assembly 14. After the diesel particulate filter assembly 14 is removed from the exhaust aftertreatment system and supported by the support fixture 12, the method proceeds to Box 66. At Box 66, the acoustic generator 30 is coupled directly to the diesel particulate filter assembly 14.

The acoustic generator 30 may, for example, include a single transducer, a transducer array (as shown), or a phased array transducer. The acoustic generator 30, as shown, includes an array of transducers 32, 34, 36, 38, 40, and 42, such as, for example, sonic transducers or ultrasonic transducers. A coupling pad 48 may be provided to prevent attenuation caused by air and liquid and to protect the delicate structure of the filter 18 from damage due to the high-energy vibrations produced by the acoustic generator 30. While water may cause less attenuation than gas, liquids may not be practical or desirable. For example, liquids may substantially degrade the mat 24 and/or substantially reduce the strength of the filter 18 against mechanical vibrations. While any number of materials is contemplated for the coupling pad 48, it may be desirable to use something deformable and durable, such as, for example, a high-strength rubber, paper, or soft metal.

After the acoustic generator 30 and diesel particulate filter assembly 14 have been coupled, the method proceeds to Box 68, where the acoustic generator 30 generates acoustic energy. Although sound and ultrasound of any frequency may be desired, it may be preferable to provide ultrasound having a frequency of about 20 kilohertz to about 50 kilohertz, wherein "about" indicates rounding to one significant digit. For example, 20.4 is about 20, 20.54 is about 20.5, etc. Additionally, it may be desirable to provide ultrasound having a modulated or unmodulated frequency in a continuous or periodic burst mode. Further, it may be desirable to continuously generate ultrasonic energy for a predetermined time period while the acoustic generator 30 is coupled with the diesel particulate filter assembly 14. Whether a single transducer or a transducer array is used, it may be desirable or even necessary, to move the one or more transducers about the surface of the gas outlet 28. It may also be desirable to evaluate the filter 18 after acoustic energy has been used to determine if the process should be repeated and/or the one or more transducers repositioned.

The acoustic energy is used, at Box 70, to dislodge particulate matter, such as ash 44 and 46, deposited within the diesel particulate filter assembly 14. From Box 70, the method proceeds to Box 72. At Box 72, dislodged ash, such as dislodged ash particles 50 and 52, is allowed to leave the diesel particulate filter assembly 14 in a gravitational direction, represented by "G" in FIG. 1. Alternatively, or additionally, pressurized air may be directed by a pressurized air device 54 (FIG. 2) through the passages of the filter 18 to assist in removing the dislodged ash 50 and 52. If the diesel particulate filter assembly 14 is oriented with the gas inlet 26 facing downward, it may be useful to direct pressurized air vertically downward through the diesel particulate filter assembly 14 to assist in removing the dislodged ash 50 and 52. The pressurized air device 54 may be moved about the surface of the gas outlet 28 to assist in removing all dislodged ash, such as dislodged ash particles 50 and 52. After the ash 44 and 46 has been dislodged using acoustic energy produced by the acoustic generator 30 and removed from the filter 18, the method proceeds to an END, at Box 74.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A system for cleaning a diesel particulate filter, comprising:

a support fixture for supporting a diesel particulate filter;

an acoustic generator for generating acoustic energy; and a coupling pad for transferring the acoustic energy from the acoustic generator through the diesel particulate filter to remove ash deposited within the diesel particulate filter, wherein one of the support fixture and the acoustic generator is movable with respect to the other to allow the coupling pad to be in direct contact with the acoustic generator and the diesel particulate filter.

2. The system of claim 1, wherein the acoustic generator includes at least one of a sonic transducer and an ultrasonic transducer.

3. The system of claim 2, wherein the ultrasonic transducer includes a phased-array transducer.

4. A system for cleaning a diesel particulate filter, comprising:

a support fixture for supporting a diesel particulate filter;

an acoustic generator for generating acoustic energy, one of the support fixture and the acoustic generator being movable with respect to the other; and a coupling pad for transferring the acoustic energy from the acoustic generator through the diesel particulate filter to remove ash deposited within the diesel particulate filter, wherein the acoustic generator includes an array of ultrasonic transducers, wherein a perimeter of the array is about equal to or smaller than a perimeter of an outlet face of the diesel particulate filter.

5. The system of claim 4, wherein the array of transducers is configured to generate ultrasonic energy in a frequency range of about 20 kilohertz to about 50 kilohertz.

6. The system of claim 5, wherein the array of transducers is further configured to generate ultrasonic energy having at least one of a modulated frequency and an unmodulated frequency.

* * * * *